US007246451B2

(12) United States Patent
Victorov et al.

(10) Patent No.: US 7,246,451 B2
(45) Date of Patent: Jul. 24, 2007

(54) TUMBLER-DRYER FOR CAPSULES

(75) Inventors: Herman Victorov, Windsor (CA); Eugen C. Dinescu, LaSalle (CA)

(73) Assignee: Technophar Equipment & Service Limited, Tecumseh, Ontario (CA)

( * ) Notice: Subject to any disclaimer, the term of this patent is extended or adjusted under 35 U.S.C. 154(b) by 0 days.

(21) Appl. No.: 10/955,957

(22) Filed: Sep. 30, 2004

(65) Prior Publication Data

US 2006/0070254 A1 Apr. 6, 2006

(51) Int. Cl.
*F26B 11/02* (2006.01)

(52) U.S. Cl. ..... 34/129; 34/166; 34/171; 34/321

(58) Field of Classification Search ..... 34/58, 34/315, 318, 321, 322, 104, 109, 184, 187, 34/171–173, 166, 589, 590, 127, 113, 129; 68/142; 99/471
See application file for complete search history.

(56) References Cited

U.S. PATENT DOCUMENTS

| | | | | |
|---|---|---|---|---|
| 295,205 | A | 3/1884 | Shickle | |
| 495,153 | A | 4/1893 | Doughty | |
| 591,307 | A | 10/1897 | Tupholme | |
| 618,644 | A | 1/1899 | Collins | |
| 764,226 | A | 7/1904 | Cottrell | |
| 934,772 | A | 9/1909 | Urgelles | |
| 958,823 | A | 5/1910 | Prinz | |
| 958,824 | A | 5/1910 | Prinz | |
| 1,030,210 | A | 6/1912 | Simon | |
| 1,191,123 | A | 7/1916 | Collins | |
| 1,294,805 | A | 2/1919 | Horst | |
| 1,419,131 | A | 6/1922 | Foster | |
| 1,434,664 | A | 11/1922 | Ortega | |
| 1,450,917 | A | 4/1923 | Goldthorpe | |
| 1,547,655 | A | 7/1925 | Johnston | |
| 1,587,727 | A | 6/1926 | Harty et al. | |
| 1,800,228 | A | 4/1931 | Pierce | |
| 1,974,250 | A | 9/1934 | Osborn | |
| 1,994,343 | A * | 3/1935 | Graves | 99/471 |
| 2,002,094 | A | 5/1935 | Maede | |
| 2,271,757 | A | 2/1942 | Boltz | |
| 2,399,570 | A | 4/1946 | Petersen | |
| 2,670,548 | A | 3/1954 | Huebsch | |
| 2,687,578 | A | 8/1954 | Richterkessing | |
| 2,712,182 | A | 7/1955 | Vetorino | |
| 2,742,710 | A | 4/1956 | Richterkessing | |
| 2,870,545 | A | 1/1959 | Richterkessing | |
| 3,207,494 | A | 9/1965 | Jager | |
| 3,292,350 | A | 12/1966 | Tasset | |
| 3,815,257 | A * | 6/1974 | Freze | 34/129 |
| 4,094,633 | A | 6/1978 | Peterson et al. | |
| 4,868,999 | A | 9/1989 | Radomsky | |
| 4,934,559 | A | 6/1990 | Putnam | |
| 5,054,209 | A * | 10/1991 | Koff | 34/58 |
| 5,307,567 | A | 5/1994 | Schnake et al. | |
| 5,768,800 | A * | 6/1998 | Merritt et al. | 34/576 |
| 6,510,785 | B1 * | 1/2003 | Margolin | 99/495 |
| 6,732,553 | B2 * | 5/2004 | Rhode et al. | 68/20 |

* cited by examiner

*Primary Examiner*—Kenneth Rinehart
(74) *Attorney, Agent, or Firm*—Harness, Dickey and Pierce, P.L.C.

(57) ABSTRACT

A capsule dryer utilizes an upper level having a plurality of drying baskets and a lower level having a plurality of drying baskets disposed beneath the upper level of drying baskets. The footprint of the capsule dryer is thus reduced while providing a same or superior drying capabilities. Furthermore, the drying baskets at the different levels are independently controlled.

37 Claims, 12 Drawing Sheets

TUMBLER-DRYER FOR CAPSULES

BACKGROUND AND SUMMARY OF THE INVENTION

The present invention relates to soft capsule making and more particularly to a tumbler-dryer used for making soft capsules.

Typical soft encapsulation machines for use in making pharmaceutical medicines form at least two flexible gelatin sheets or ribbons by cooling molten gelatin on separate drums. The sheets are lubricated and guided into communication with each other over co-acting dies. Simultaneously, a desired quantity of fill material is dispensed between the sheets in synch with cavities in the outer surfaces of the dies to produce soft capsules. The soft capsules are transported from the encapsulation machine to a drying machine to dry (in other words, remove moisture from) the soft capsules and make them into their final form. The soft capsules are typically transported from the encapsulation machine to the dryer by a conveyor that extends along the front of the encapsulation machine.

The drying machine typically includes a plurality of axially aligned drying drums or baskets. The baskets are arranged adjacent one another and allow capsules to flow from one basket into the next adjacent basket. Heated air is routed through the various baskets to dry the capsules therein. Furthermore, after passing through the drying baskets, the capsules may also need to be routed through a drying tunnel wherein further moisture is removed from the capsules to obtain the desired state of dryness or moisture content. This drying process can require a significant number of baskets to dry the capsules to a desired moisture content. The capsules get dryer in each subsequent drying basket they flow into. This results in a large dryer requiring a large foot print or area of a factory in which it is employed. Furthermore, the use of drying tunnels also undesirably increases the area or footprint of the overall drying equipment required to dry the capsules to a desired moisture content.

Space in the manufacturing facility, however, may be at a premium. Therefore, it would be advantageous to reduce the size and/or footprint of the drying machines. Furthermore, it would be even more advantageous if a larger capacity or throughput can be achieved in the same or smaller footprint.

Typically, all of the baskets of conventional machinery are driven at a same rotational speed by a single belt drive unit. The required rotational speed of the baskets, however, can vary based upon the moisture content in the capsules. Thus, as the capsules get dryer and pass from one drying basket to the next, the required rotational speed may change. Since all the baskets are driven at the same rate of speed by a single belt drive mechanism, however, all of the baskets must be rotated at the same speed which will correspond to the speed of the most demanding of the drying baskets. The rotating of all the baskets at a same or uniform rotational speed can be inefficient and slow the drying process. Accordingly, it would be advantageous to be able to rotate the different baskets at different rotational speeds depending upon the needs of the capsules being dried therein.

A capsule dryer, according to the principles of the present invention, utilizes an upper level having a plurality of drying baskets and a lower level having a plurality of drying baskets disposed beneath the upper level of drying baskets. By providing upper and lower levels of drying baskets, the footprint of the capsule dryer can be reduced while providing the same or superior drying capabilities. Accordingly, the required area in a factory using the capsule dryer can be reduced thus allowing additional space in the factory for other equipment or tasks.

In another aspect of the present invention, the rotation of the drying baskets at the different levels are independently controlled and driven. This advantageously enables the upper and lower level baskets to be driven at different rotational speeds according to the needs of the capsules being dried therein. Accordingly, more efficient operation of the capsule dryer can be achieved along with an increase in throughput capacity.

In yet another aspect of the present invention, the capsule dryer utilizes a drive mechanism to rotate the drying drums. There is a programmable control device which is operable to control operation of the drive mechanism. The use of a control device is advantageous in that it facilitates the controlling of the operation and can also be integrated into or utilize the same control device that controls the encapsulation machine that produces the soft capsules. The control device can also control the routing of the capsules from one drying basket to the next drying basket. The control device is advantageous in that it can facilitate the transferring of capsules from one basket to the next and coordinate the same with all the baskets. This coordination can increase the throughput of the capsule dryer, increase the efficiency of the drying operation and reduce the complexity of the control system.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

Figure 1:
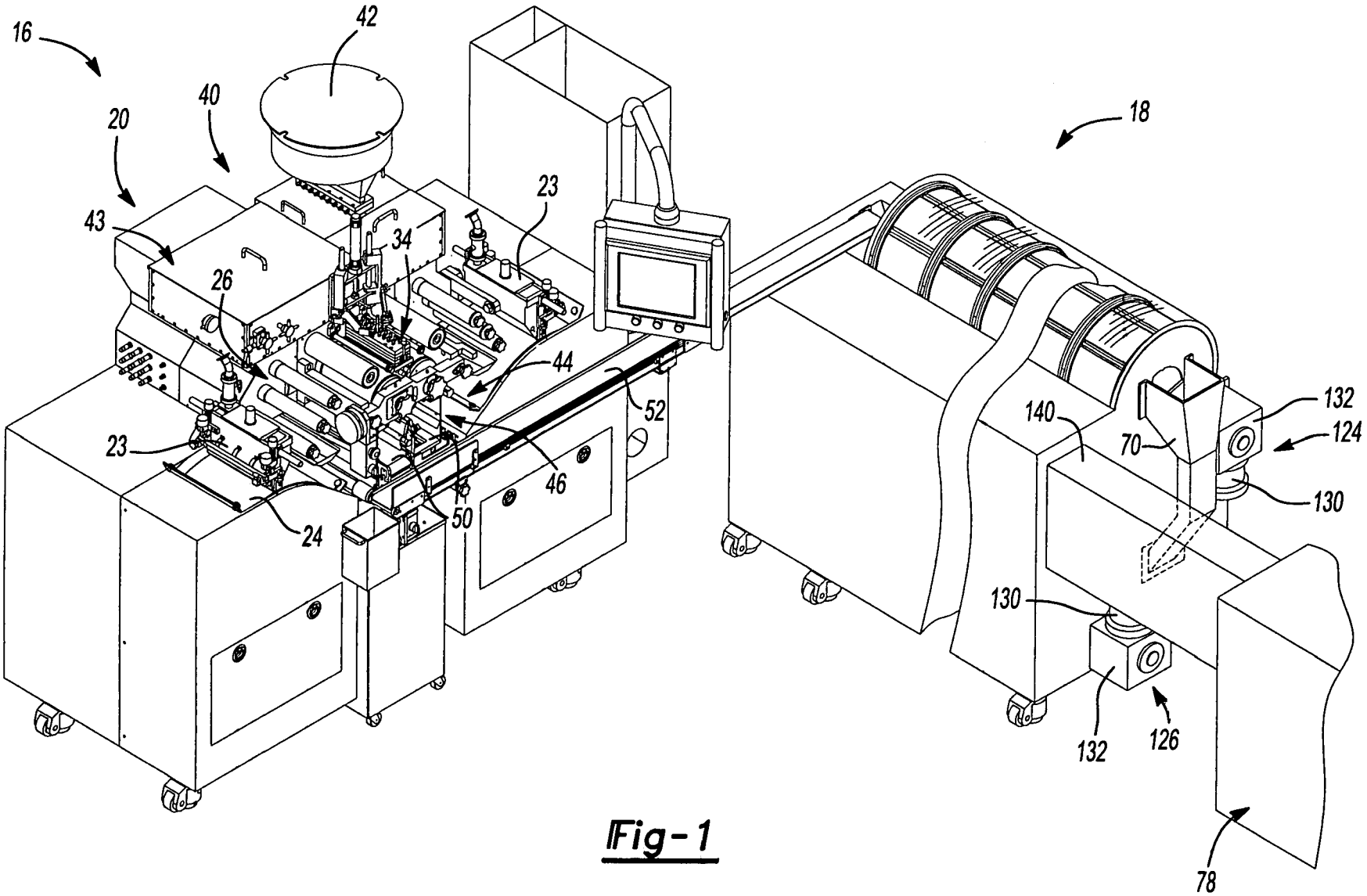
FIG. 1 is a perspective view of a soft capsule making system according to the principles of the present invention including an encapsulation machine and a capsule dryer.
Figure 2:
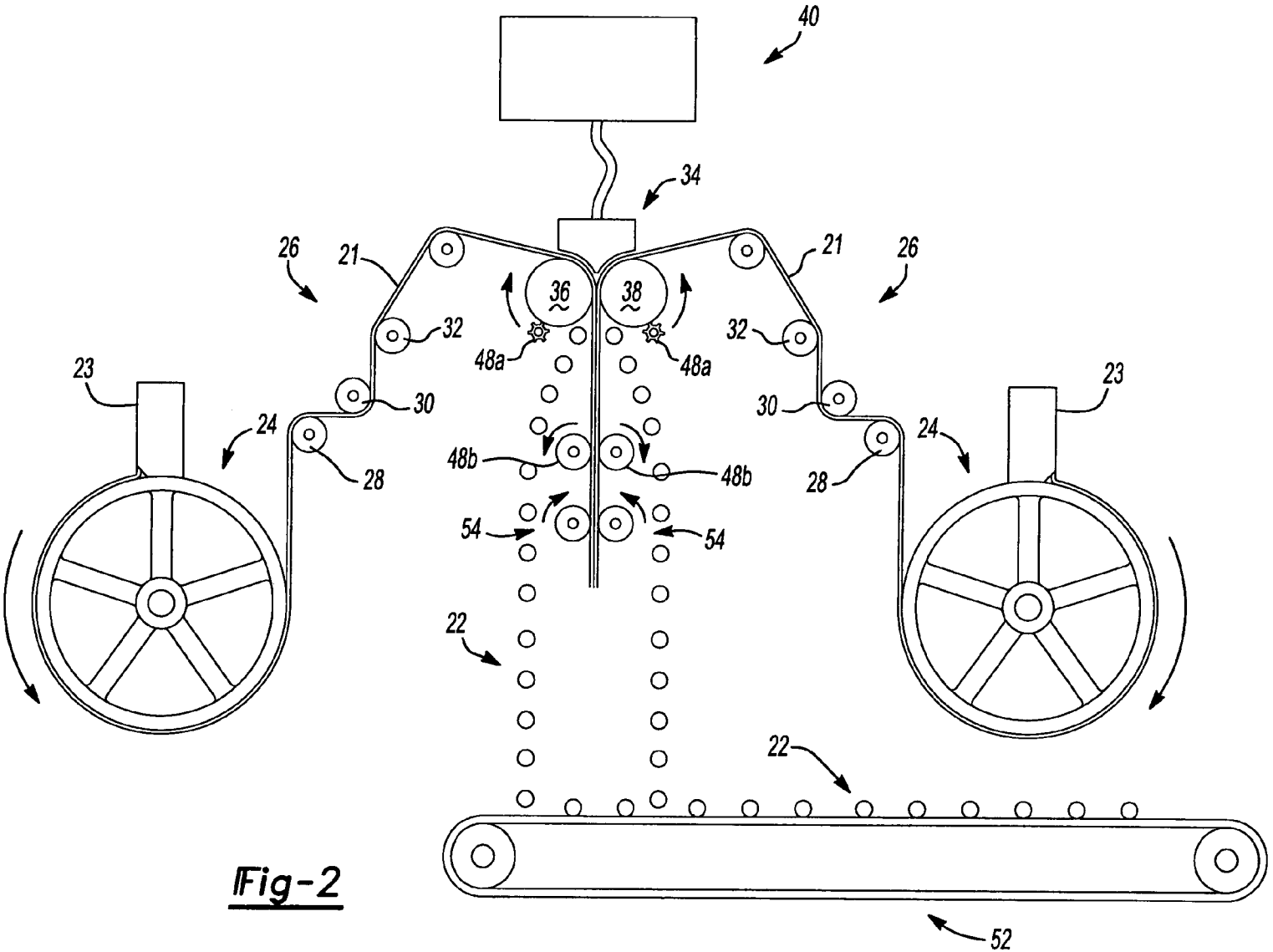
FIG. 2 is a schematic representation of a portion of the encapsulation machine used in the soft capsule making system of FIG. 1.

A soft capsule making system 16 according to the principles of the present invention is shown in FIG. 1. System 16 includes a capsule dryer machine 18 and a soft gel encapsulation machine 20. A schematic representation of a portion of encapsulation machine 20 is shown in FIG. 2. Encapsulation machine 20 is operable to produce soft gel capsules with a fill material therein while dryer machine 18 is operable to remove moisture from the capsules. The fill materials can take a variety of forms. For example, the fill material can be a solid suspension or other material. The soft gel capsules produced by encapsulation machine 20 can be used for a variety of purposes. For example, the fill material can be a medicine and the soft capsules used to administer the medicine, the fill material can be a paint or die substance and the soft gel capsules used in a paint ball gun or similar type applications, and the fill material can be an oil and the capsules used as dissolvable bath beads, among other uses.

Encapsulation machine 20 is essentially the same as that disclosed in U.S. patent application Ser. No. 10/677,141, entitled "Servo Control for Capsule Making Machine," by Victorov et al., the disclosure of which is incorporated by reference herein. Encapsulation machine 20 produces two continuous flexible gelatin films/sheets/ribbons 21 on either side of the machine that are subsequently joined together with a fill material injected therebetween to form the soft gel capsules 22. The production of the two gelatin films are substantially the same for both sides of encapsulation machine 20 and are essentially mirror images of one another. A gelatin tank (not shown) provides a gelatin in a molten state that is fed through hoses (not shown) into spreader boxes 23 that are located above casting drums 24. Spreader boxes 23 spread molten gelatin on rotating casting drums 24. Casting drums 24 are internally liquid cooled and are externally air cooled. The cooling causes the molten gelatin that is spread on casting drums 24 to solidify and form flexible gelatin sheets 21. Each casting drum 24 produces a continuous flexible gelatin sheet that is used to form a portion of each capsule. Each of the casting drums 24 are driven by servomotors (not shown) which provide precise control of the rotation of casting drums 24.

The gelatin sheets formed on casting drums 24 flow through oil roller assemblies 26. The oil roller assemblies include three rollers, 28, 30, 32. First roller 28 is driven by a variable speed motor (not shown) which is operated to cause first roller 28 to rotate at a desired rate. Second and third rollers 30, 32 are mechanically linked to first roller 28 and, thus, their rate of rotation is also controlled by the rate rotation of first roller 28. One side of the gelatin sheet 21 is in contact with second roller 30 while the opposite side of the gelatin sheet is in contact with third roller 32. Second and third rollers 30, 32 each have a plurality of openings therein that allow an oil or lubricant to be applied to both sides of the gelatin sheet as it passes along the rollers.

The two gelatin sheets flow into contact with wedge assembly 34 and then through co-acting dies 36, 38. Wedge assembly 34 heats the sheets and supplies the fill material between the two gelatin sheets that is encapsulated within the soft gel capsules produced by dies 36, 38. The fill material is supplied to wedge assembly 34 from a fill mechanism 40. Fill supply mechanism 40 includes a fill material hopper 42 that supplies the fill material to a pump assembly 43 that pumps the fill material into wedge assembly 34.

The two gelatin sheets travel between wedge assembly 34 and die assembly 44 and fill material is injected between the sheets by wedge assembly 34. Dies 36, 38 rotate toward one another when producing soft gel capsules 22. Die 36 is driven by a servomotor (not shown). Die 38 is mechanically linked to die 36 so that dies 36, 38 rotate together. The mechanical link between dies 36, 38 provides synchronization of the two dies relative to one another during operation. The use of a mechanical linkage is advantageous in that it eliminates the need for another costly servomotor to drive the other die and the potential for non-synchronized operation due to programming or operator errors. The servomotor enables precise control of the rate of rotation of dies 36, 38 and of the exact position of dies 36, 38 at all times. Each die 36, 38 has a plurality of cavities thereon (not shown) that the gelatin sheets are pushed into by the fill material and cause the two sheets to be sealed together and cut along the cavities on the dies 36, 38 encapsulating the fill material therein and forming the soft gel capsules 22.

The soft gel capsules 22 produced between dies 36, 38 and the remaining gelatin sheets flow to a divider assembly 46. Divider assembly 46 includes a first pair of stripper rollers 48*a* that rotate at a relatively high speed very close to dies 36, 38 and a second pair of stripper rollers 48*b* that rotate at a relatively high speed in contact with the sheets to remove any soft gel capsules that are clinging to dies 36, 38 and/or the gelatin sheets. The stripper rollers 48*a*, 48*b* are driven by a variable speed motor (not shown) that allows the speed of striper rollers 48*a*, 48*b* to be controlled. The soft gel capsules 22 fall onto conveyors 50 that bring the soft gel capsules 22 to the front portion of the machine and onto a second conveyor 52, which takes capsules 22 to dryer machine 18.

The gelatin sheets, after passing along the stripper rollers 48*a*, 48*b* flow into a mangle roller assembly 54, wherein a pair of mangle rollers pull on the gelatin sheets and provide tension thereon. The mangle rollers are driven by a variable speed motor (not shown) so that the speed of rotation of the mangle rollers can be adjusted. The mangle rollers are operated to provide a desired amount of tension in the gelatin sheets throughout encapsulation machine 20.

Referring now to FIGS. 3-9, the details of dryer machine 18 are shown. Dryer machine 18 can include a plurality of casters or wheels 58. Dryer machine 18 included a plurality of drying baskets of drums 60 within which capsules 22 are dried. There is a first group 66 of axially aligned baskets 60 that are located at a first level or elevation. A second group 68 of axially aligned baskets 60 are at a second level or elevation. Preferably, as shown, first group 66 is disposed above second group 68. Covers (not all shown) are disposed around first and second groups 66, 68. The covers can be made from a variety of materials. For example, transparent polymeric covers, such as Lexan®, and stainless steel covers can be used. A chute 70 (FIGS. 3A and 3B) interconnects first group 66 to second group 68. Chute 70 routes capsules 22 from first group 66 to second group 68 during the drying process. An inlet 72 is disposed adjacent first group 66 and receives capsules 22 from conveyor 52. An outlet 74 through which dried capsules 22 exit dryer machine 18 is disposed adjacent second group 68. Capsules 22 flow into first group of baskets 66 via inlet 72. Capsules 22 sequentially flow, as described below, through each basket 60 of first group 66 on the first level and into chute 70. Chute 70 directs capsules 22 into second group of baskets 68. Capsules 22 flow sequentially, as described below, through each basket 60 of second group of baskets 68 and exit via outlet 74.

Figure 9:
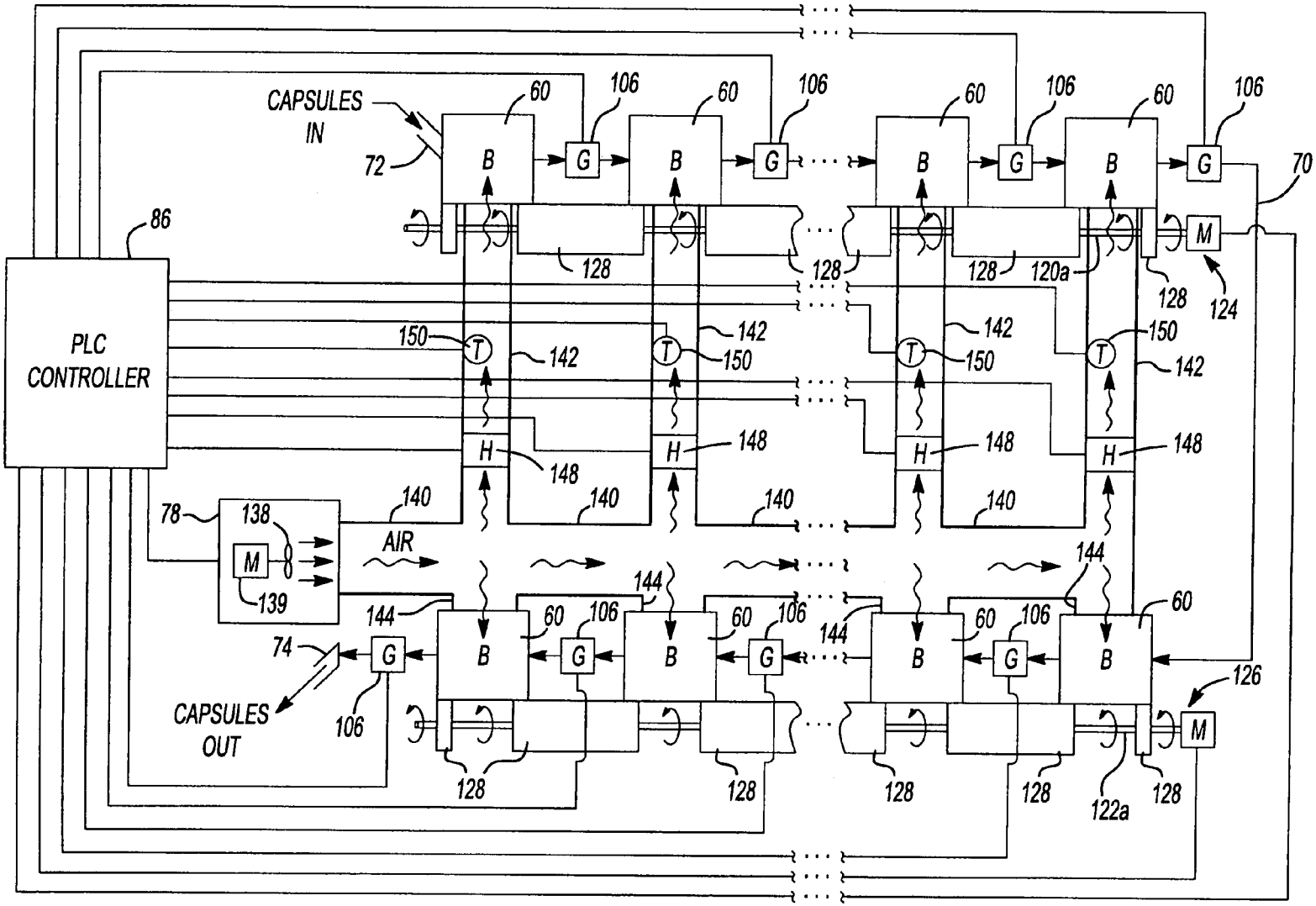
FIG. 9 is a schematic representation of the drying process for capsules flowing through the capsule dryer of FIG. 1.

Baskets 60 receive a fluid flow, such as air, and rotate while drying capsules 22. The air flow is provided by an air unit 78 which feeds air to a duct assembly 80. Duct assembly 80 directs a portion of the air flow therein to each basket 60. The air flow helps move the capsules 22 through each basket 60, as described below. Duct assembly 80 is operable to individually heat the different portions flowing to the individual baskets 60 of first group 66, as described in more detail below. A drive mechanism 84 drives the rotation of baskets 60, as described in more detail below. A programmable logic controller (hereinafter "PLC") or control device 86, as shown in FIG. 9, communicates with and controls operation of air unit 78, duct assembly 80 and drive mechanism 84, as described below.

Figure 5:
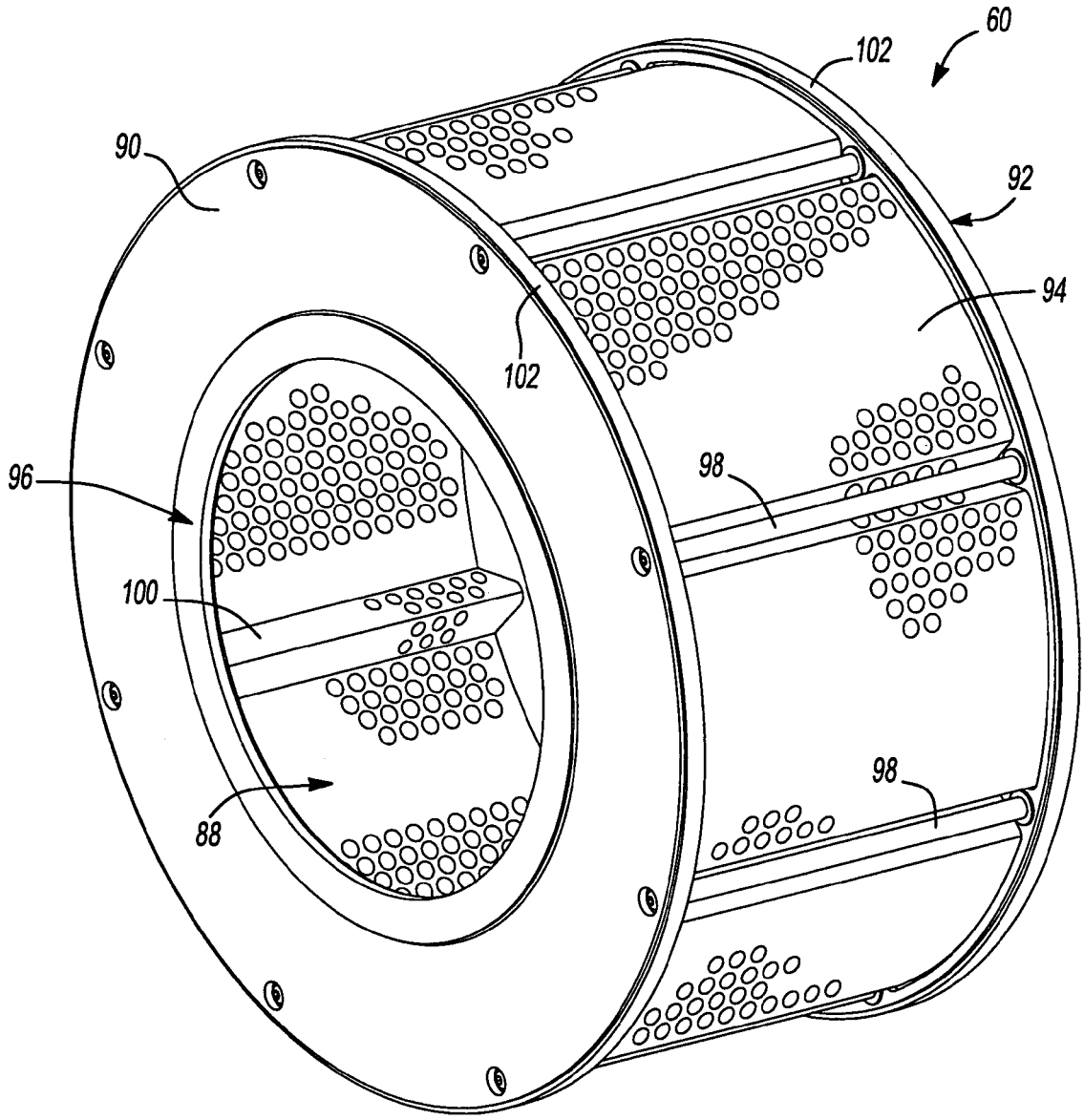
FIG. 5 is a perspective view of a drying basket used in the capsule dryer of FIG. 1.

Referring now to FIG. 5, each basket 60 is generally cylindrical with an interior cavity 88 defined by a pair of annular end walls 90, 92 and an outer wall 94 extending therebetween. Each end wall 90, 92 has a central opening 96 to allow access to cavity 88. End walls 90, 92 are preferably made of an epon resin, such as epon resin 825.

End walls 90, 92 are spaced apart by a plurality of bars 98. Outer wall 94 is disposed between end walls 90, 92 and is configured to have recesses in which bars 98 reside. The engagement between bars 98 and the recesses prevent outer wall 94 from rotating relative to end walls 90, 92 and bars 98.

Outer wall 94 is perforated or meshed to allow the air supplied by duct assembly 80 to flow through cavity 88 and remove moisture from capsules 22 therein. The recesses in outer wall 94 within which bars 98 reside, form a plurality of ramps or bumps 100 that radially project into cavity 88. Bumps 100 interact with capsules 22 to lift and drop the capsules 22 within cavity 88 when basket 60 is rotating. Outer wall 94 is made of stainless steel. Additionally, bars 98 are also made of stainless steel.

Each end wall 90, 92 has a V-belt 102 that extends radially around its outer circumference. V-belt 102 engages with wheels or rollers of drive mechanism 84 to cause basket 60 to rotate, as described in more detail below. V-belts 102 are preferably made of urethane.

Figure 6A:
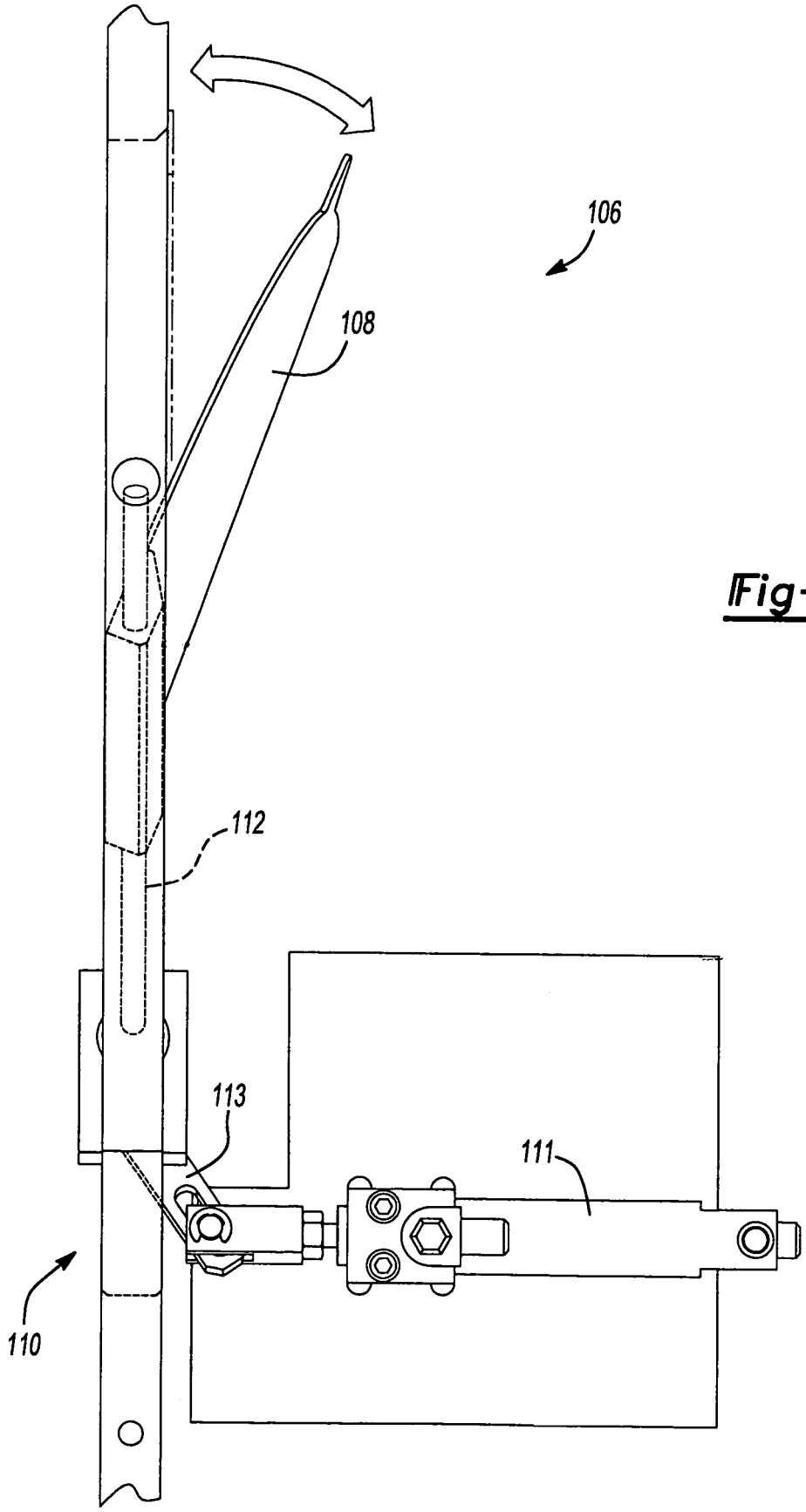
FIGS. 6A and 6B are respective side elevation and perspective views of the gate assemblies of the capsule dryer of FIG. 1.
Figure 6B:
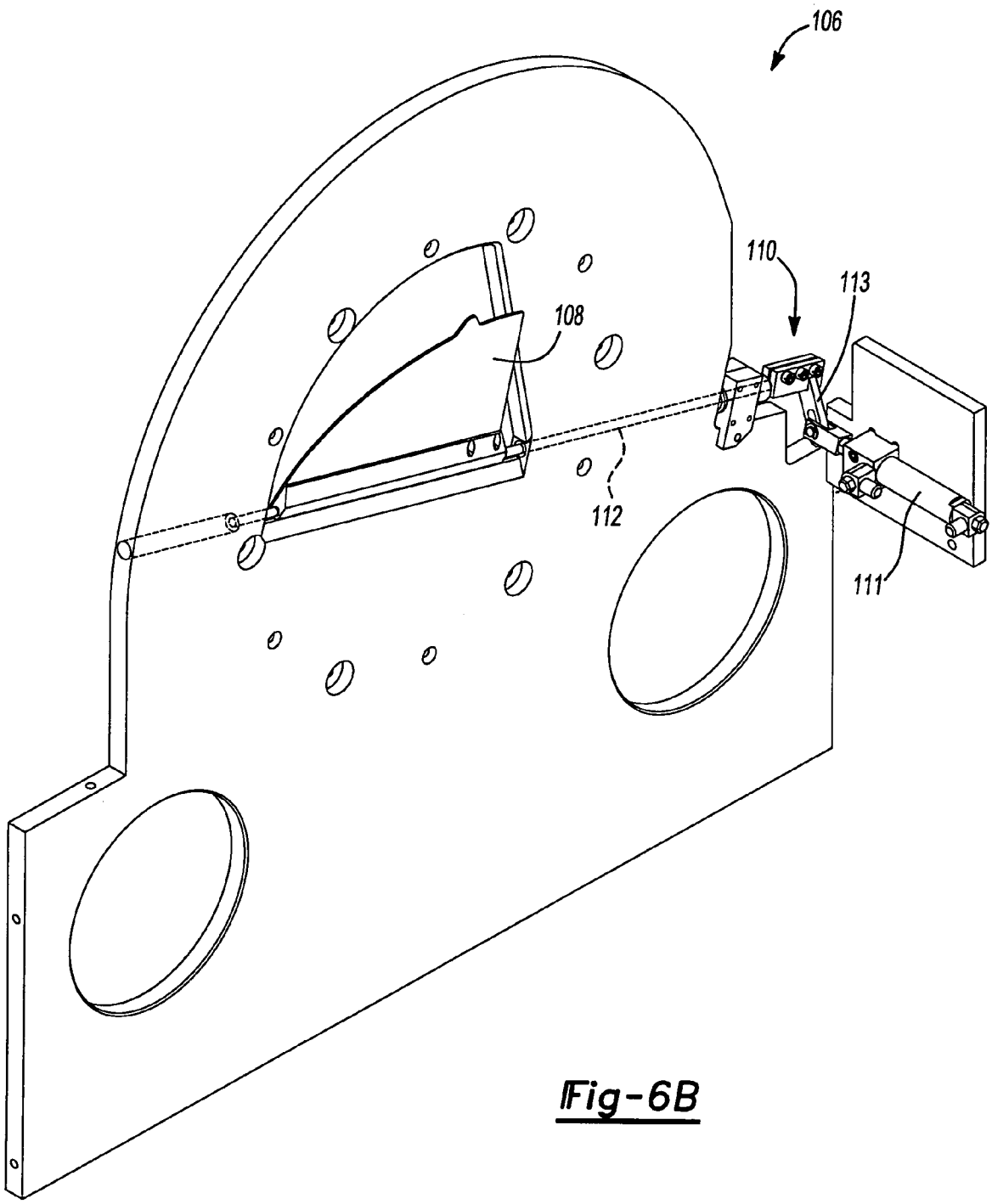
Figure 7:
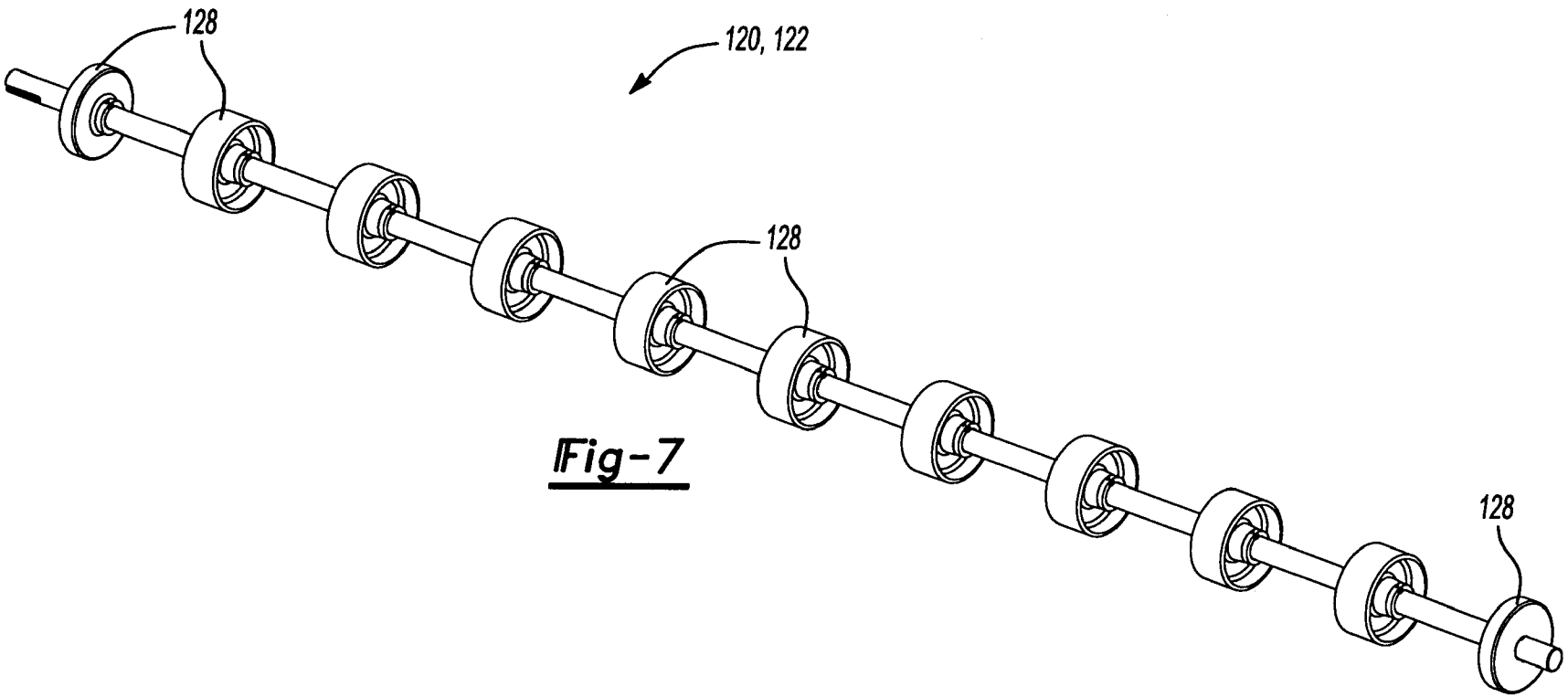
FIG. 7 is a perspective view of one of the drive shafts used in the capsule dryer of FIG. 1 to drive rotation of the drying baskets.

To route capsules 22 from one basket 60 to the next basket, to chute 70, or outlet 74, dryer machine 18 includes a plurality of gate assemblies 106 (best seen in FIGS. 6A and 6B). Gate assemblies 106 are disposed between adjacent baskets 60, between chute 70 and an end basket 60 of first group 66 and between outlet 74 and an end basket 60 of second group 68. Each gate assembly 106 includes a movable gate 108, a linkage assembly 110 coupled to gate 108 and a linear actuator 111 coupled to linkage assembly 110. Linkage assembly 110 includes a connecting rod 112 fixedly connected to gate 108 and a link 113 fixedly connected to rod 112 and pivotally connected to actuator 111. Actuator 111 can take a variety of forms. For example, actuator 111 can be a fluidic actuator or a solenoid. Actuator 111 is operable to move gate 108, via linkage assembly 110, between a closed position (substantially horizontal) and an open position (inclined). In the open position gate 108 protrudes into a cavity 88 of an adjacent basket 60. That is, linear motion of actuator 111 causes link 113 to rotate rod 112 which in turn moves gate 108 between the open and closed positions. Preferably, the open position of gate 108 corresponds to gate 108 being between about 43 to 45 degrees from vertical.

When gate 108 is in the open position, gate 108 extends into cavity 88 of an adjacent basket 60. When basket 60 is rotating, capsules 22 therein will be lifted upwardly by bumps 100 and fall downwardly as basket 60 rotates. A portion of the air flow supplied to each basket 60 is directed toward a downstream basket to push capsules 22 toward gate 108. As a result, some capsules 22 will land on gate 108 and slide along gate 108 into the next adjacent basket 60, chute 70, or outlet 74. On the other hand, when gate 108 is in the closed position, capsules 22 will be lifted and freely fall within cavity 88 of basket 60 without moving onward to the next adjacent basket 60, chute 70, or outlet 74. Thus, gate assemblies 106 can be selectively operated to advance capsules 22 throughout dryer machine 18 or maintain capsules 22 within their existing basket 60.

PLC 86 communicates with each gate assembly 106. Controller 86 controls the operation of gate 108 and commands actuator 111 to open and close gate 108 as needed to route capsules 22 throughout first and second groups 66, 68 of baskets 60, as described below.

Referring now to FIGS. 3A, 3B, 4, 7 and 8, details of drive mechanism 84 are shown. Drive mechanism 84 includes four drive shafts 120*a*, 120*b*, 122*a*, 122*b* and two drive units 124, 126. Drive unit 124 and drive shafts 120*a*, 120*b* are associated with first group of baskets 66 while drive unit 126 and drive shafts 122*a*, 122*b* are associated with second group of baskets 68. Each drive shaft 120, 122 has a plurality of rollers 128 upon which baskets 60 rest. Specifically, V-belts 102 on each basket 60 rest on rollers 128 on the associated drive shafts 120, 122. The rollers 128 on the ends of drive shafts 120, 122 support a single basket 60 while the interior rollers 128 each support two baskets 60. Drive shafts 120*a*, 122*a* are driven while the other drive shafts 120*b*, 122*b* are not driven and are free to rotate.

Each drive unit 124, 126 includes a motor 130 and a gear box 132 that are coupled together. Gear boxes 132 of drive units 124, 126 are respectively coupled to driven drive shafts 120*a*, 122*a* to drive rotation of first and second groups of baskets 66, 68, respectively. As driven drive shafts 120*a*, 122*a* are rotated by respective drive units 124, 126, baskets 60 residing thereon will rotate. As baskets 60 are residing on both a driven and non-driven drive shaft, rotation of the baskets will cause non-driven drive shafts 120*b*, 122*b* to also rotate. Non-driven drive shafts 120*b*, 122*b* thereby facilitate the rotation of baskets 60 in response to rotation of driven drive shafts 120*a*, 122*a*. Drive units 124, 126 are independent of one another and can be individually operated.

Referring now to FIG. 9, PLC 86 communicates with each drive unit 124, 126. Controller 86 is operable to independently command each drive unit 124, 126 to rotate the associated group of baskets 66, 68. That is, controller 86 can command drive unit 124 to cause rotation of first group of baskets 66 at a desired rotational speed while also commanding drive unit 126 to cause second group of baskets 68 to remain stationary, rotate at a faster rotational speed, a same rotational speed or a slower rotational speed as that of first group of baskets 66 and vice versa. The ability to independently control drive units 124, 126 enables first and second groups of baskets 66, 68 to be rotated at different rotational speeds based upon the drying needs of capsules 22 therein. Accordingly, the rotation of first and second groups of baskets 66, 68 can be optimized to provide for the efficient drying of capsules 22 within dryer machine 18.

Figure 3A:
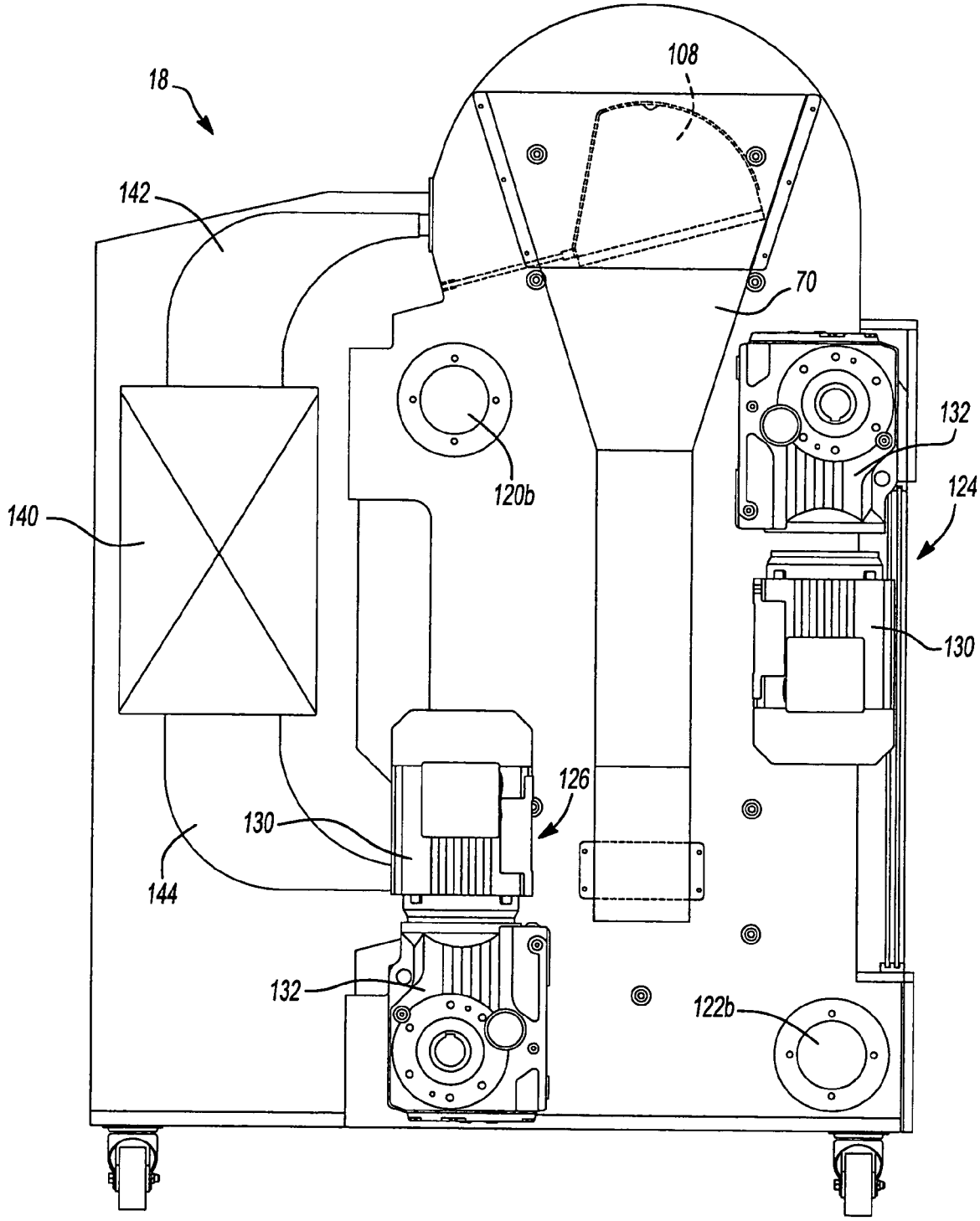
FIGS. 3A, 3B and 3C are an end and two opposite side elevation views of the capsule dryer used in the soft capsule making system of FIG. 1.
Figure 3B:
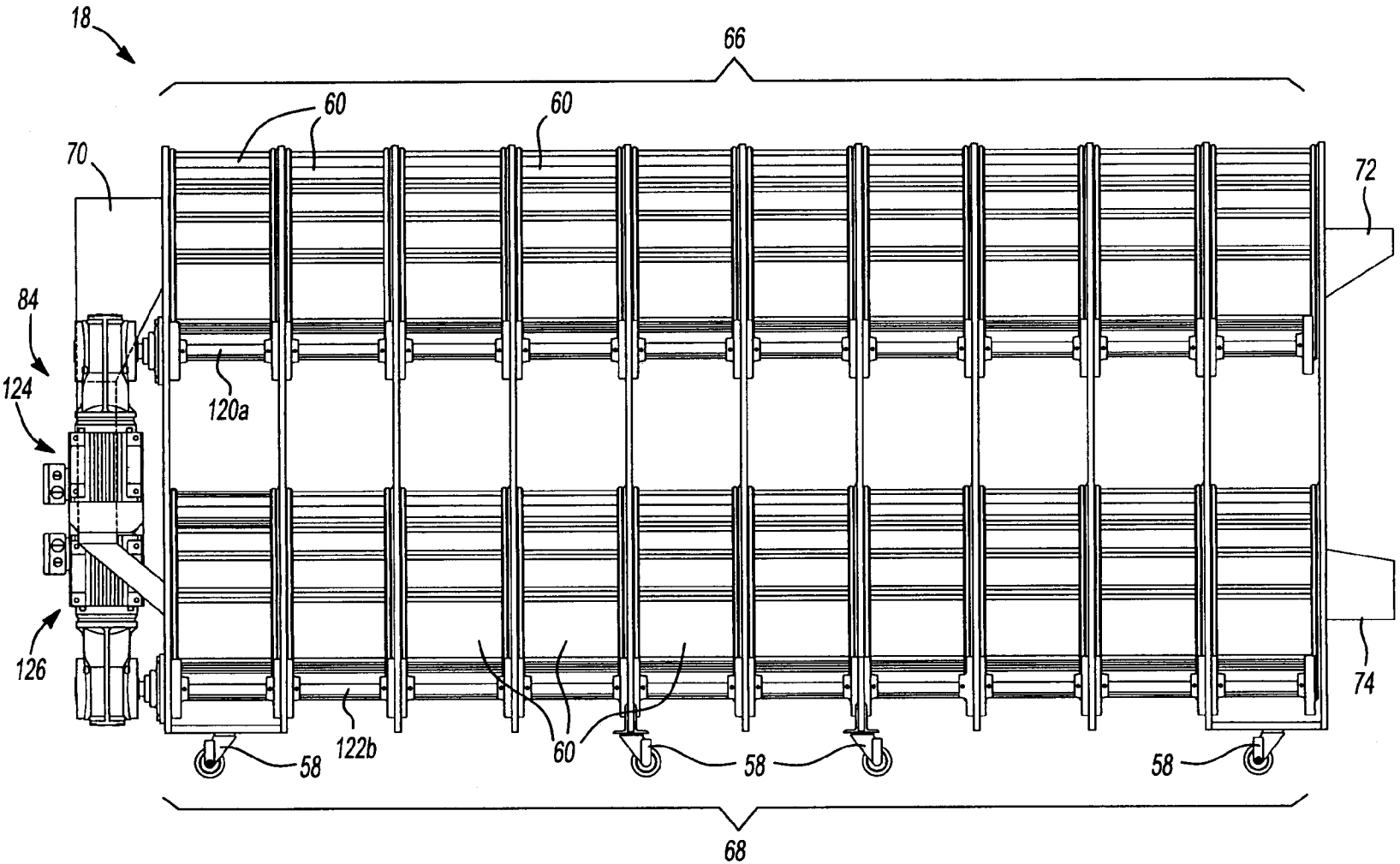
Figure 3C:
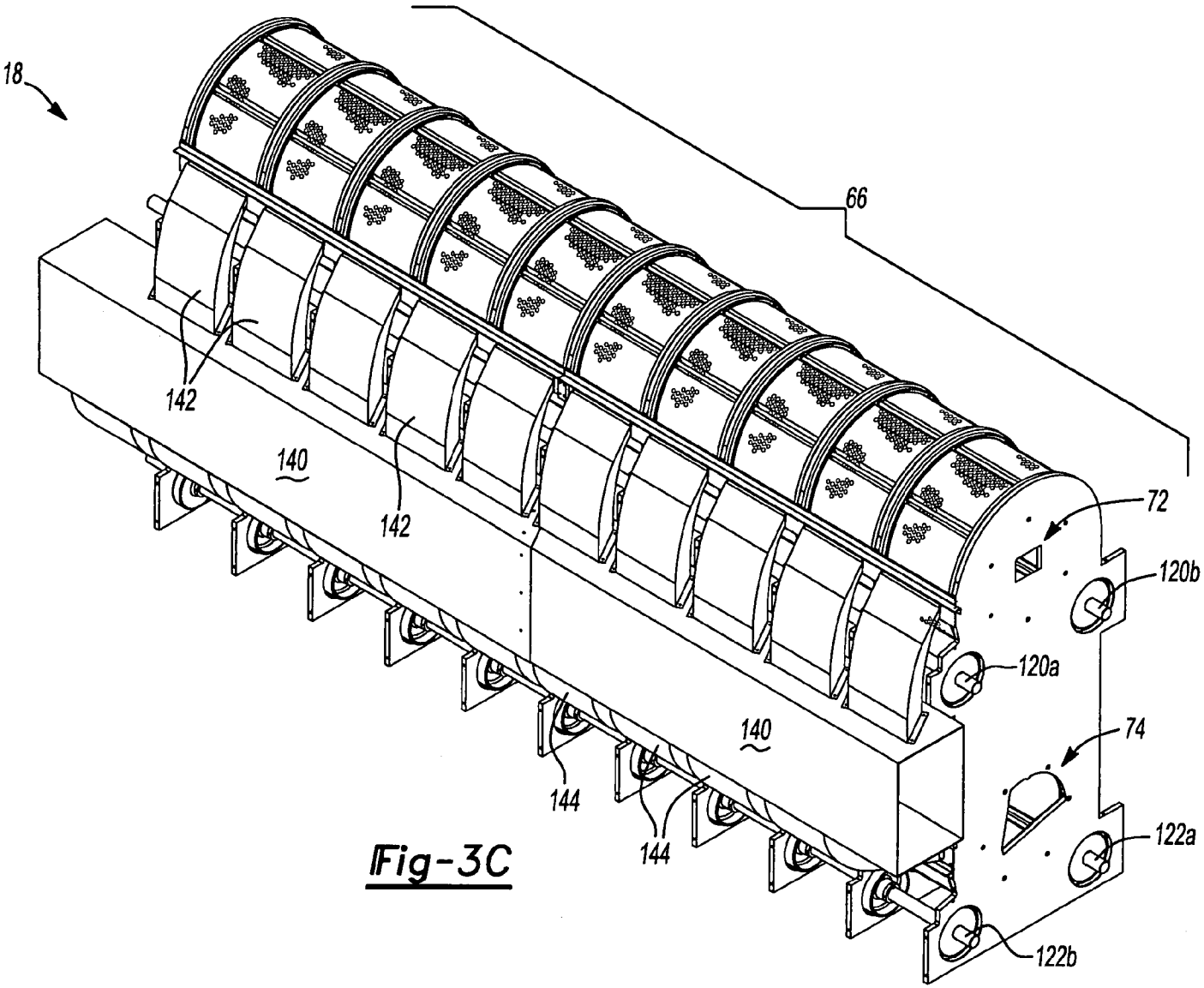
Figure 4:
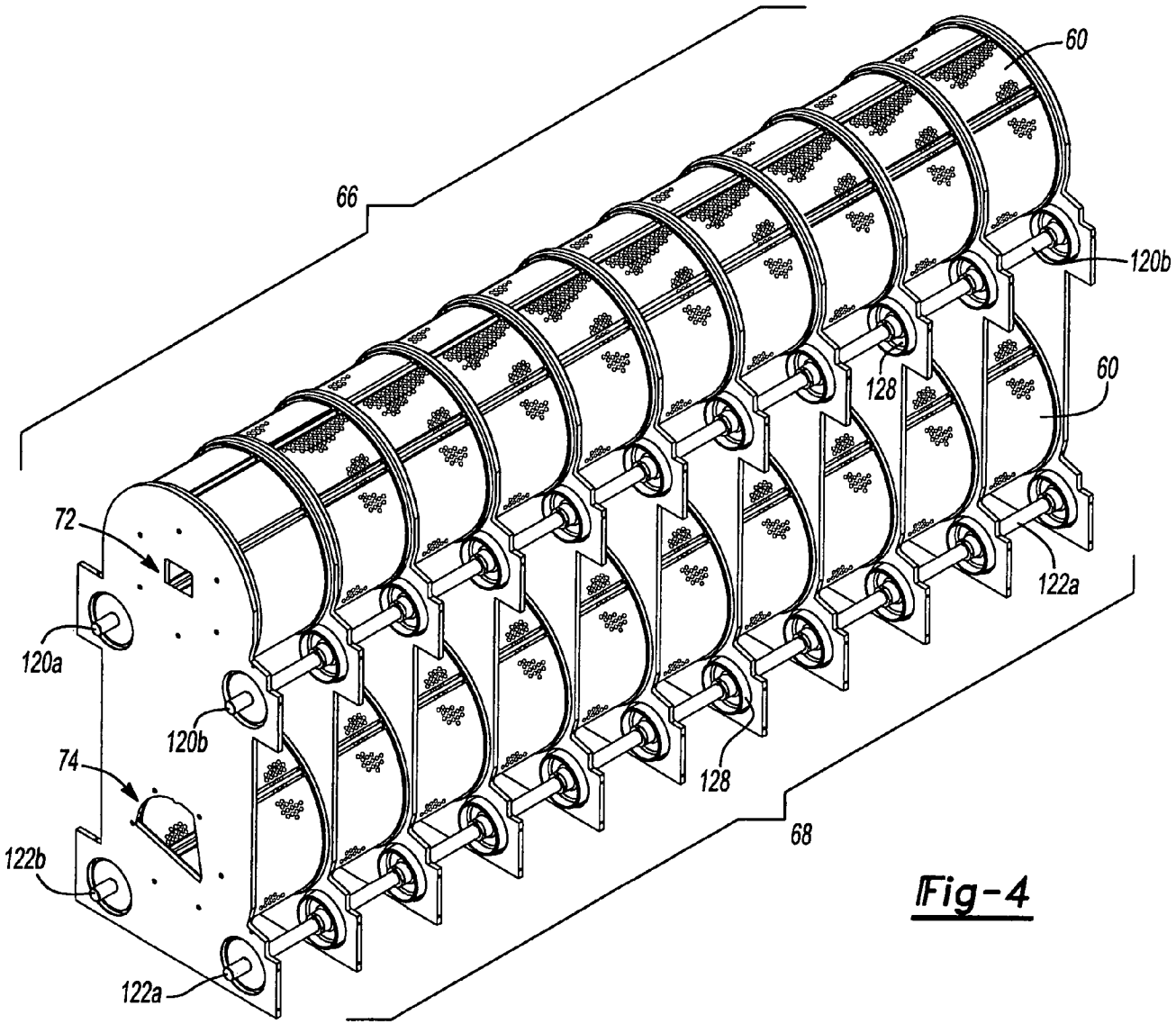
FIG. 4 is a perspective view of the capsule dryer of FIG. 1 with the duct work for supplying air to the baskets removed.
Figure 8:
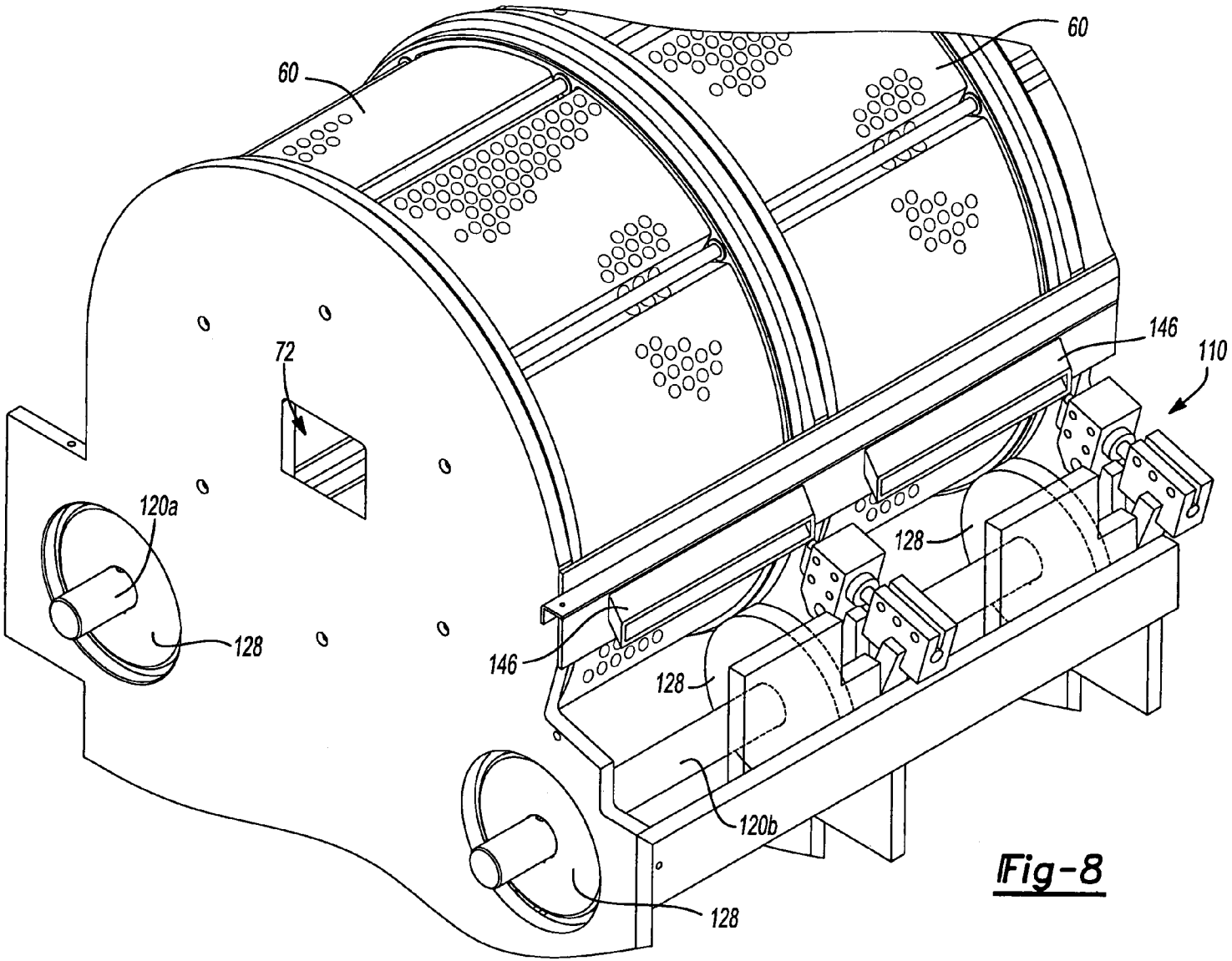
FIG. 8 is a fragmented partial perspective view of the capsule dryer of FIG. 1 with most of the duct work removed.

Referring now to FIGS. 1, 3A, 3C, 8, and 9, details of air unit 78 and duct assembly 80 are shown. Air unit 78 includes a blower or fan 138 coupled to a motor 139 and is operable to provide a flow of air to duct assembly 80. Duct assembly 80 includes a main duct 140 that extends along the side of dryer machine 18 in a generally central location relative to first and second groups of baskets 66, 68. A plurality of upper duct connectors 142 extend from main duct 140 and direct air flow from main duct 140 to baskets 60 in first group of baskets 66. There is one upper duct connector 142 for each basket 60 in first group of baskets 66. A plurality of lower duct connectors 144 extend from main duct 140 and direct air flow from main duct 140 to baskets 60 in second group of baskets 68. There is one lower duct connector 144 for each basket 60 in second group of baskets 68. As best seen in FIG. 3A, the profile of duct connectors 142, 144 diminishes as the duct connectors approach basket 60. As shown in FIG. 8, the end of each duct connector 142, 144 is connected to an inlet 146 (only upper inlets for first group of baskets shown) that directs the air flow therethrough into an associated basket 60.

Upper duct connectors 142, as shown schematically in FIG. 9, each have a heater 148 therein to heat the air flowing therethrough. Lower duct connectors 144, however, do not have a heater therein. Each heater 148 communicates with and is independently controlled by PLC 86 to provide an air flow of a desired temperature to each basket 60 in first group of baskets 66. A temperature sensor 150 is also provided in each upper duct connector 142 and communicates with PLC 86. PLC 86 controls the operation of heaters 148 to provide a desired drying profile along the length of dryer machine 18. Heaters 148 can take a variety of forms. For example, heaters 148 can be electrical heaters.

Operation of dryer machine 18 to dry capsules 22 is explained with reference to FIG. 9. PLC 86 commands drive units 124, 126 to rotate drive shafts 120*a*, 122*a* to rotate baskets 60 in first and second groups of baskets 66, 68. Rotation of drive shafts 120*a*, 122*a* is imparted onto basket 60 in first and second groups of baskets 66, 68 via rollers 128 disposed thereon. PLC 86 controls the rotational speed of first and second groups of baskets 66, 68 independently of one another to provide a desired rotation for the baskets in the associated group.

PLC 86 also commands air unit 78 to supply a flow of air to main duct 140 which in turn flows into upper and lower duct connectors 142, 144. For example, air unit 78 can be commanded to supply an air flow, such as 6000 CFM, to main duct 140. PLC 86 independently commands each heater 148 to heat the air flow through upper duct connectors 142 prior to flowing into an associated basket 60 in first group of baskets 66. PLC 86 monitors the temperature of the air flowing to each basket 60 in first group of baskets 66 via inputs from temperature sensors 150. PLC 86 monitors the temperature flowing into the baskets and adjusts the temperature, as needed, to provide a desired drying profile along the length of first group of baskets 66. For example, air flowing into the first basket of first group 66 may be set in a range between about 30 to 60 degrees Celsius while air flowing into the last basket in first group of baskets 66 may be set in a range between about 30 to 60 degrees Celsius.

With first and second groups of baskets 66, 68 rotating and receiving an air flow from air unit 78, dryer machine 18 is ready to receive capsules 22. Conveyor 52 supplies capsules 22 to inlet 72. Inlet 72 directs capsules 22 into the first basket 60 of first group of baskets 66. Capsules 22 in the first basket are tumbled and moisture is removed therefrom. At the appropriate time, PLC 86 will command actuator 111 to open the gate 108 that is between the first and second baskets of first group of baskets 66 to allow some capsules within the first basket to flow into the adjacent basket. Once in the adjacent basket, the capsules therein will continue to be tumbled and continue having moisture removed therefrom. PLC 86 continues to command additional actuators 111 associated with additional gates 108 further downstream to open and close, as appropriate, to further advance capsules 22 from one basket into an adjacent basket. Simultaneously, additional capsules 22 continue to be fed into the first basket via inlet 72.

The capsules 22 continue to proceed sequentially through each basket 60 in first group of baskets 66 until entering chute 70 which directs capsules 22 into the first basket 60 of second group of baskets 68. PLC 86, at the appropriate time, commands actuators 111 associated with gates 108 disposed adjacent baskets 60 in second group of baskets 68 to selectively open and close to advance capsules 22 sequentially through each basket 60 in second group of baskets 68. Capsules 22 progress through each basket 60 in second group of baskets 68 until reaching outlet 74 wherein capsules 22 exit dryer machine 18 for packaging and/or further processing.

PLC 86 can utilize programmed algorithms, set points, lookup table(s), and/or individual adjustments thereto to control the rotational rates of the baskets, the operation of the various gates 108, the operation of air unit 78 and the heaters to remove a desired amount of moisture from capsules 22 flowing therethrough. The use of PLC 86 simplifies operation of dryer machine 18 while advantageously providing for customized control.

The dryer machine 18 made according to the principles of the present invention is predicted to provide superior drying capabilities and performance. For example, such a dryer machine is predicted to produce capsules 22 that exit the dryer machine with a moisture content in a range of about 7-80 percent in the shell (i.e., removal in the range of about 93-20 percent of the moisture from the shell) in the single process of flowing through first and second groups of baskets 66, 68. This is a significant improvement over heretofore prior art dryers which have typically been operable to remove about 18-24 percent of moisture in a single processing step. Accordingly, capsules 22 exiting dryer machine 18 may not require further processing and/or heat tunnels to remove additional moisture. Thus, the present invention can reduce the cycle time associated with drying capsules 22 and provide for a less expensive drying apparatus by avoiding the use of heating tunnels and/or additional trays and equipment to move capsules 22 through additional processing equipment. Furthermore, the drying can be done in the same or smaller size area in the manufacturing facility.

While the present invention has been shown and described by reference to specific embodiments and examples, it should be appreciated that variations and changes in capsule making system 16 and capsule dryer machine 18 can be employed without departing from the spirit and scope of the present invention. For example, heaters can be added to lower duct connectors 144 if desired. Furthermore, the number of baskets 60 in first and second groups of baskets 66, 68 can vary from the number shown. The total number of baskets in each group 66, 68 will depend upon the drying needs of the capsules 22 to be dried therein. Additionally, while dryer machine 18 is shown as having two groups of baskets 66, 68 with one disposed above the other, a 2×2 machine can be employed wherein there are two rows of baskets on a first level and two rows of baskets disposed therebelow or any number of upper and lower groups of baskets, such as a 3×2, 3×3, 1×3, 1×4, etc., as desired. Moreover, dryer machine 18 can have more than two rows, such as three, four or more rows, as desired. Additionally, the rows do not need to be stacked one on top of the other. Rather, the rows can be adjacent or offset.

Furthermore, a sorter or similar device can be employed to sort the capsules into various groups, such as by size or shape, with each group being routed to a specific group of baskets for drying therein, although all of the advantages may not be realized. Moreover, PLC 86 can be a stand alone controller that operates only drying machine 18, can be a component of the controller that operates the capsule making system 16 and/or encapsulation machine 20, or can be the same controller that operates encapsulation machine 20 and/or capsule making system 16. Accordingly, the present invention is merely exemplary in nature and such variations are not to be regarded as a departure from the spirit and scope of the present invention.

What is claimed is:

1. A capsule dryer comprising:

an upper level having a plurality of drying drums; and a lower level having a plurality of drying drums, said lower level being located substantially beneath said upper level, wherein material being dried in the capsule dryer flows sequentially through each of said upper level drums and then through each of said lower level drums, further comprising a plurality of upper level gates disposed between said upper level drying drums and a plurality of lower level gates disposed between said lower level drying drums, said gates selectively allowing material in one of said drying drums to flow into an adjacent one of said drying drums, wherein each of said gates is coupled to a fluidic actuator operable to selectively open and close an associated gate.

2. The capsule dryer of claim 1, further comprising:

at least one driving mechanism operable to rotate said upper level drying drums at a first rotational speed and to rotate said lower level drying drums at a second rotational speed different than said first rotational speed, wherein said material to be dried flows sequentially through each of said drying drums on one of said levels in a first direction and flows sequentially through each of said drying drums on the other of said levels in a second direction substantially opposite of said first direction.

3. The capsule dryer of claim 2, wherein said driving mechanism includes upper and lower level drives operable to respectively rotate said upper and lower level drying drums, and each of said upper and lower level drives is independently driven.

4. The capsule dryer of claim 3, further comprising a programmable controller operable to independently control operation of said upper and lower level drives.

5. The capsule dryer of claim 2, further comprising a chute communicating with one of said upper level drying drums and one of said lower level drying drums, said chute operable to route material in said upper level dying drum to said lower level drying drum.

6. The capsule dryer of claim 1, further comprising a fluid supply system operable to flow a fluid to at least one of said upper and lower level drying drums to remove moisture from capsules therein.

7. The capsule dryer of claim 1, wherein said plurality of upper level drying drums each rotates about a first axis and said plurality of lower level drying drums each rotates about a second axis different than said first axis.

8. The capsule dryer of claim 7, wherein said first and second axes are substantially parallel.

9. The capsule dryer of claim 1, further comprising:

a fluid supply system operable to supply a flow of heated fluid to one of said upper level drying drums and said lower level drying drums and a flow of unheated fluid to the other of said upper level drying drums and said lower level drying drums.

10. The capsule dryer of claim 9, wherein said fluid supply system is operable to supply a flow of heated fluid to said upper level drying drums and a flow of unheated fluid to said lower level drying drums.

11. A capsule dryer comprising:

a plurality of capsule drying drums;

a drive mechanism operable to independently rotate a first of said drying drums at a first rotational speed and independently rotate a second of said drying drums at a second rotational speed different than said first rotational speed;

a programmable control device operable to control operation of said drive mechanism; and a plurality of gates disposed between adjacent ones of said drying drums, said gates selectively allowing capsules in one of said drying drums to flow into an adjacent one of said drying drums, and wherein said control device controls operation of said gates.

12. The soft capsule dryer of claim 11, wherein a first group of said drying drums are located substantially above a second group of said drying drums.

13. The soft capsule dryer of claim 12, wherein said drive mechanism includes a first motor operable to drive rotation of said first group of drying drums, a second motor operable to drive rotation of said second group of drying drums and said control device controls operation of said first and second motors.

14. The soft capsule dryer of claim 11, further comprising a fluid supply system operable to flow a fluid to said drying drum to remove moisture from capsules therein.

15. The capsule dryer of claim 11, wherein the plurality of capsule drying drums further comprises:

an upper level having at least one capsule drying drum rotatable about a first axis and operable to dry capsules therein;

a lower level having at least one capsule drying drum rotatable about a second axis different than said first axis and operable to dry capsules therein, said lower level being located substantially beneath said upper level; and capsules being dried in said upper and lower level drying drums.

16. The capsule dryer of claim 15, wherein said capsules being dried are filled with a pharmaceutical.

17. The capsule dryer of claim 15, wherein said capsules being dried are filled with paint.

18. The capsule dryer of claim 11, wherein said capsules being dried are filled with bath oil.

19. A soft-gel capsule dryer comprising:

an upper level having at least four axially aligned capsule drying baskets each rotatable about a substantially horizontal upper axis;

a first automatically powered transmission driving rotation of said upper level baskets and allowing speed adjustment during drying;

a lower level having at least four axially aligned capsule drying baskets each rotatable about a substantially horizontal lower axis, said lower axis being different than said upper axis;

a second automatically powered transmission driving rotation of said lower level baskets and allowing speed adjustment during drying;

a chute acting as a substantially vertical soft-gel capsule flow path between at least one of said upper level baskets and at least one of said lower level baskets;

at least one blower supplying drying air to at least one of said baskets; and a programmable controller operably controlling drying operation.

20. The soft-gel capsule dryer of claim 19, wherein soft-gel capsules travel sequentially through each of said upper level baskets and then through each of said lower level baskets.

21. The soft-gel capsule dryer of claim 20, further comprising an entrance to an upper level flow path through said upper level baskets and an exit to a lower level flow path through said lower level baskets and wherein said entrance and said exit are on a same side of the soft-gel capsule dryer.

22. The soft-gel capsule dryer of claim 19, wherein the soft-gel capsules include a medicine.

23. The soft-gel capsule dryer of claim 19, wherein the soft-gel capsules include a paint.

24. The soft-gel capsule dryer of claim 19, wherein the soft-gel capsules include a bath oil.

25. The soft-gel capsule dryer of claim 19, wherein the soft-gel capsules include a liquid.

26. The soft-gel capsule dryer of claim 19, wherein soft-gel capsules enter and exit the soft-gel capsule dryer on a same side of the soft-gel capsule dryer.

27. The soft-gel capsule dryer of claim 19, further comprising casters.

28. The soft-gel capsule dryer of claim 19, wherein a majority portion of said lower level baskets are beneath said upper level baskets.

29. The soft-gel capsule dryer of claim 19, wherein said baskets are generally cylindrical.

30. The soft-gel capsule dryer of claim 19, wherein said upper and lower axes are in a same vertical plane.

31. The capsule dryer of claim 19, wherein said upper and lower rotational axes are substantially parallel.

32. The capsule dryer of claim 19, wherein said drying baskets are tumble drying baskets.

33. The capsule dryer of claim 19, wherein said transmissions are operable to rotate said upper drying baskets at a first rotational speed and to rotate said lower drying baskets at a second rotational speed different than said first rotational speed.

34. The capsule dryer of claim 19, further comprising:

a fluid supply system operable to independently heat fluid flowing to at least two of said drying drums in at least one of said upper and lower levels.

35. The capsule dryer of claim 34, wherein said fluid supply system is operable to supply a flow of heated fluid to said drying drums in one of said upper and lower levels and to supply a flow of unheated fluid to said drying drums in the other of said upper and lower levels.

36. The capsule dryer of claim 34, wherein said fluid supply system is operable to independently heat fluid flowing to each drying drum in at least one of said upper and lower levels.

37. The capsule dryer of claim 19, further comprising capsules being dried have two portions that are joined together and contain a fill material therein.

* * * * *

UNITED STATES PATENT AND TRADEMARK OFFICE

CERTIFICATE OF CORRECTION

PATENT NO. : 7,246,451 B2
APPLICATION NO. : 10/955957
DATED : July 24, 2007
INVENTOR(S) : Herman Victorov and Eugen C. Dinescu It is certified that error appears in the above-identified patent and that said Letters Patent is hereby corrected as shown below:

Column 3, line 54, after second occurrence of "rate", insert --of--.

Column 9, line 56, Claim 5, "dying" should be --drying--.

Column 10, line 52, Claim 18, "of claim 11" should be --of claim 15--.

Signed and Sealed this

First Day of July, 2008

JON W. DUDAS
*Director of the United States Patent and Trademark Office*